United States Patent [19]

Standlick et al.

[11] Patent Number: 4,852,773

[45] Date of Patent: Aug. 1, 1989

[54] ADJUSTABLE FLOW APPLICATOR FOR A POSITIVE DISPLACEMENT CONSTANT FLOW-RATE DISPENSER

[75] Inventors: Ronald E. Standlick, Rochester; David A. Standlick, Utica, both of Mich.

[73] Assignee: Jesco Products Company, Inc., Sterling Heights, Mich.

[21] Appl. No.: 138,713

[22] Filed: Dec. 28, 1987

[51] Int. Cl.[4] ..... B67D 3/00

[52] U.S. Cl. ..... 222/504; 222/559; 251/60

[58] Field of Search ..... 222/504, 559, 334; 901/43; 251/60, 63, 63.5, 285; 92/13, 13.3, 13.8; 239/584

[56] References Cited

U.S. PATENT DOCUMENTS

| | | | |
|---|---|---|---|
| 3,132,775 | 5/1964 | Trumbull et al. | 222/453 |
| 3,155,365 | 11/1964 | Hartung et al. | 251/60 X |
| 3,160,331 | 12/1964 | Trumbull et al. | 222/309 |
| 3,180,527 | 4/1965 | Wasilewski et al. | 222/334 X |
| 3,802,605 | 4/1974 | Standlick | 222/134 |
| 3,991,661 | 11/1976 | Mocha | 92/13 X |
| 4,085,659 | 4/1978 | Stunkel | 92/13.8 X |
| 4,378,335 | 3/1983 | Boden et al. | 251/63 X |
| 4,465,212 | 8/1984 | Boone | 222/559 X |
| 4,651,906 | 3/1987 | Hoffmann et al. | 222/504 |
| 4,678,100 | 7/1987 | Gelinas et al. | 222/504 X |
| 4,690,310 | 9/1987 | Rasmussen | 222/334 X |
| 4,711,379 | 12/1987 | Price | 222/504 |
| 4,747,576 | 5/1988 | Saito et al. | 251/60 |
| 4,801,051 | 1/1989 | Lewis et al. | 222/309 |

*Primary Examiner*—Michael S. Huppert
*Attorney, Agent, or Firm*—Dykema Gossett

[57] ABSTRACT

An adjustable flow applicator includes a body having an axial flow pasasge and an inlet passage adapted for connection to a source of pressurized fluidic material dispensed by a positive displacement constant flow rate dispenser. A nozzle is connected to the body and communicates with the flow passage and has an orifice. A reciprocal piston rod extension is spaced within the flow passage and terminates in a tapered valve member having an advanced position seated within the orifice to shut off flow of fluidic material and first and second retracted positions variably opening the orifice for reduced flow in a first position and higher flow in a second position. First remote control includes a first piston connected to the piston extension for effecting alternate reciprocal movements of the valve member for alternately opening and closing the orifice. A second pneumatic control includes a piston rod coaxially adjacent to the first piston and includes a reciprocal second piston which has an advanced position for limiting axial retracting movements of the valve member for limited flow of material and an alternate retracted position away from the first piston so the first piston can move to a fully retracted position.

22 Claims, 1 Drawing Sheet

ADJUSTABLE FLOW APPLICATOR FOR A POSITIVE DISPLACEMENT CONSTANT FLOW-RATE DISPENSER

FIELD OF INVENTION

This invention relates to an adjustable flow applicator or gun used in conjunction with a positive displacement constant flow rate dispenser which delivers pressurized fluidic materials such as epoxies, urethanes, elastomers, or two component resin-active systems to the applicator and which instantly provides a flow rate change upon command. The invention is intended to maintain at the orifice or outlet of the applicator a constant back pressure at various flow rates. The applicator has use in many industries such as automotive, aerospace, aircraft, marine, electronic, industrial, furniture or ordinance and in particular where robotized dispensing systems are employed.

BACKGROUND OF THE INVENTION

Previously, in robotized dispensing systems, the applicator or gun for pressurized fluidic materials was so mounted as to negotiate tight pattern radii at a uniform speed of movement which rendered it difficult to maintain a consistent bead size in the applied materials when used with constant flow rate dispensers. Thus, there has existed the need and capability for immediately changing flow rate of the fluidized material in order to adjust to a change in robot travel speed, such as a slowing down in negotiating sharp turns and at the same time maintaining a uniformity of bead size.

Many robotized adhesive or sealant applications require a change in the tip or nozzle velocity as the top enters a difficult corner or pattern which requires a slower dispenser rate while maintaining a consistent bead diameter.

Efforts have previously been made in providing material dispensers having a constant flow rate which would have the capability of changing from one predetermined flow rate to another predetermined flow rate. These have been impractical, particularly in high tip speeds, due to the residual pressure in the whip or dispense hose between the material dispenser outlet and the applicator.

SUMMARY OF THE INVENTION

An important feature of the present invention is to provide an air-operated applicator or gun which will shift from a closed shut-off position to a full open position, a predetermined partial open position, or alternately from the two flow positions as required.

Another feature is to provide an adjustable flow applicator having an orifice or outlet where a constant back pressure is maintained with varying flow rates.

Another feature is to provide an adjustable flow applicator or a selectable flow and shut-off device for pressure feed type dispensers utilizing pressurized fluidic materials such as pressurized fluids and paste-like materials including epoxies, urethanes, elastomers, and two component resin-active systems, for illustration.

Still another feature is to provide an adjustable flow applicator having an axial flow passage and an inlet passage communicating therewith and adapted for connection to a source of pressurized fluidic material. An axially extending nozzle is connected to the body in communication with the flow passage and terminates in a converging orifice. A tapered valve member is positioned within the flow passage and nozzle and has an advanced position normally seated within the orifice for shutting off the flow of fluidic material therethrough together with first and second retractable positions variably opening the orifice for a reduced flow rate of the material when in a first position and for an increased flow rate when in a second position.

A further feature is to provide an adjustable flow applicator having automatic controls initially regulating opening and closing of the valve member for opening up or shutting off the flow of pressurized fluidic material together with an additional automatic control mechanism under remote control for determining the extent of the opening of the valve between a modified or limited opening for a reduced flow rate of material in such first position or for an increased flow rate in a second position.

A still further feature is to provide an adjustable flow applicator which has the capability of immediately changing flow rate from a higher flow to a limited or lower flow while maintaining at the orifice of the applicator a constant back pressure in order to adapt to a reduction in robot or automated tooling travel speed, such as may occur in negotiating a tight pattern radii for the purpose of maintaining a consistent and uniform bead size of the deposited material.

As another feature, the adjustable flow applicator provides for adjustment of the material back pressure at the nozzle or orifice to maintain the same back pressure during the two flow modes namely at reduced flow or a higher flow. The operation of the present adjustable flow applicator utilizes the orifice metering principle that if the pressure drop across an orifice is maintained constant, the flow will be proportional to the orifice size. This provides for a consistent and uniform bead size of the deposited fluidic material. The robot or automated tooling mounted applicator follows a predetermined pattern at speeds which will vary depending upon the radii traversed.

As a further feature of the present invention, the present adjustable flow applicator includes a first pneumatic control which is axially mounted upon the body of the applicator receiving a piston rod extension, including a first piston for effecting alternate reciprocal movements of the valve member for alternately opening and closing the orifice and additionally a second pneumatic control assembly axially mounted upon the first pneumatic control which receives the piston rod and includes a reciprocal second piston. With such a construction, the second piston has an advanced position limiting axial retracting movements of the first piston rod and valve member to a limited retracted, reduced-flow position and an alternate retracted position axially outward of the piston rod so that the valve member may move to a higher flow rate position.

Still another feature is to provide with the adjustable flow applicator a pair of first and second pneumatic control means, each including a cylinder with a reciprocal piston therein and with separate porting on each of the respective cylinders for controlling reciprocal movements of the individual pistons therein, together with individual remote controls regulating the movements of the respective first and second pistons in the respective first and second cylinders, thereby under remote control manually or automatically regulating positive opening, closing and thereby shutting down of flow through the applicator and with the valve member open controlling its open positions between an intermediate partial flow position and an increased or higher flow position.

Another feature is to provide a pressure compensating and flow shut-off applicator for a positive displacement constant flow rate dispenser, with the applicator having at the orifice a constant back pressure and having a pair of instantaneously selectable flow rates.

A further feature is to provide an adjustable flow applicator with external adjustments and which is economical in construction, easy to assemble and disassemble, and efficient in operation. Such an applicator constructed accordingly to the invention is compact, has a convenient mounting surface, and has a relatively large pressure capacity when compared to the weight of the applicator.

These and other features will be seen from the following specification and claims in conjunction with the appended drawing.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
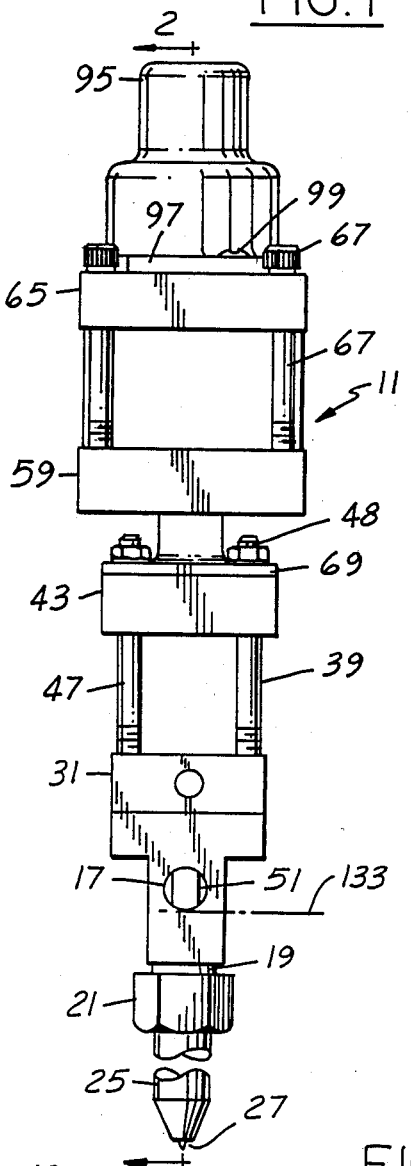
FIG. 1 is a fragmentary front elevational view of the present adjustable flow applicator.
Figure 2:
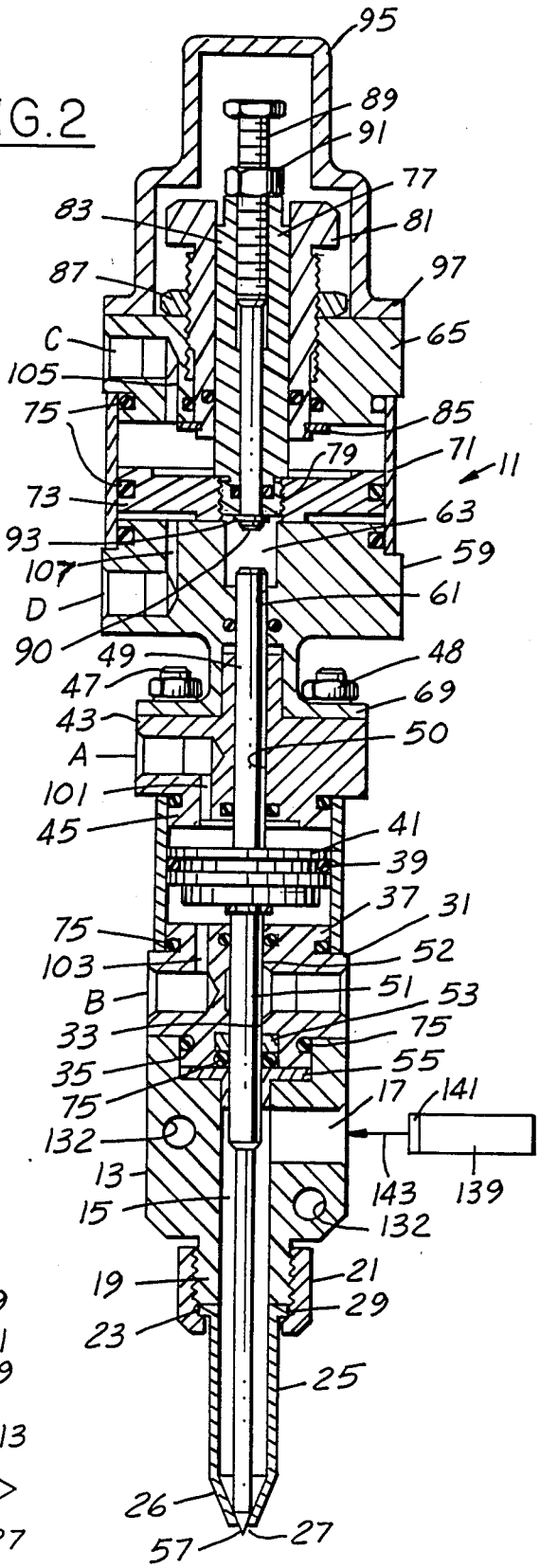
FIG. 2 is a longitudinal section thereof taken in the direction of arrows 2—2 of FIG. 1, on an increased scale and also showing schematically a positive displacement constant flow rate dispenser for supplying the dispensed material to the applicator.

Referring to the drawings, the present adjustable flow applicator or gun is generally indicated at 11, FIGS. 1 and 2. It is adapted for dispensing pressurized fluidic materials as liquids or paste-like materials including epoxies, urethanes, elastomers and two-component resin active systems. The present applicator or gun 11 is sometimes referred to as a two-position or dual or adjustable flow applicator for a robotized or automated dispensing system which includes a constant flow rate dispenser, such as the JESCO Model N-888 available from Jesco Products Company, Inc., assignee of record.

The applicator 11 includes the body 13 having an axially extending flow passage 15 and communicating therewith a transverse fluidic material inlet passage 17. Passage 17 is adapted for connection to a source of pressurized fluidic material dispensed by a constant flow rate dispenser 139 as previously described.

Body 13 at one end terminates in the axial externally threaded shank 19 upon which is threaded apertured collar 21 adapted to receive nozzle 25 and its mount flange 23 with a suitable gasket 29 interposed therebetween.

The nozzle 25, axially aligned with body 13 and removably secured thereto for replacement as desired, includes a tapered seat 26 terminating in orifice 27 which in the illustrated embodiment is 0.090 inches. This corresponds to JESCO's commercial applicator designated N-1800. There is a larger-size JESCO's applicator designated N-1900 wherein the orifice size for illustration is 0.380 inches. Construction of the larger dual or adjustable flow applicator is substantially the same as that shown in FIGS. 1 and 2.

Adapter housing 31 has an axial bore 33 and a bottom shank 35 of reduced diameter which projects into an upper portion of body 13 and is sealed therein as by the O-ring 75, a number of which are shown for sealing purposes in FIG. 2.

First cylinder tube 39 is snugly positioned over the top shank 37 of adapter housing 31 and is suitably sealed thereover and encloses the piston assembly 41, sometimes referred to as a first piston. Adapter cap 43 is axially assembled with respect to adapter housing 31 and is spaced therefrom and includes a depending shank 45 which is snugly projected and sealed within the upper end of the cylinder tube 39.

The adjustable flow applicator 11 which includes body 13, adapter housing 31, first cylinder 39, adapter cap 43 and O-ring seals 75 are secured together axially in compression by a plurality of fastener studs 47 with corresponding nuts 48 and suitable lock washers as required.

Piston rod 49 axially projects from first piston 41 slidably through the bore 50 of the adapter cap 43. The axially-arranged piston rod extension 52 depends from first piston 41 and extends through the bore 52 of adapter housing 31 and through the main seal 53. Seal 53 is constructed of POLYMYTE TM, VITON TM or any other similar material. The seal washer 55 is interposed between adapter housing 31, and body 13 underlies the main seal 53 with a suitable O-ring seal 75 interposed, FIG. 2.

Piston rod extension 51 extends loosely within the axial flow passage 15 and terminates at the tapered valve member 57. Valve member 57 is shown fully seated in FIG. 2 with respect to the tapered orifice 27, being the shut-off position to any flow of fluidic material through the orifice 27.

Tapered valve member 57 is shown in an advanced position in Figure 2, being normally seated within orifice 27 thereby shutting off flow of fluidic material therethrough from dispenser 139. Valve member 57 is part of the piston rod extension 51 and is movable to first and second retracted positions for variably opening the orifice 27 for a reduced flow rate of the material when in the first position and further retracted to a second position for a maximum flow rate of the material under the control of piston 41. In operation a constant back pressure is maintained at orifice 27 regardless of the size thereof to provide the varying flow rates just described.

Cylinder adapter 59 is axially aligned with adapter cap 43 and includes a bore 61 axially thereof and a counterbore 63 adapted to slidably receive piston rod 49 as shown in FIG. 2.

Axial cylinder cap 65 is spaced from cylinder adapter 59, with the second cylinder tube 71 interposed therebetween. The cap 65, adapter 59 and tube 71 are assembled by a plurality of cap screws 67. The screws 67 interconnect cylinder cap 65 and cylinder adapter 59 retaining the second cylinder sleeve 71 in compression and sealed relatively thereto by corresponding O-ring seals 75.

Cylinder adapter 59 has a depending transverse apertured mount flange 69 which is positioned over adapter cap 43 and retained thereon by the corresponding fastener studs 47 and nuts 48. Cylinder tube 71, sometimes referred to as a second cylinder tube, receives the second piston 73 sealed therein by a suitable O-ring 75 and adapted for reciprocal movements therein.

First pneumatic control means, which includes adapter housing 31 and adapter cap 43, includes a pair of air pressure ports A and B which through corresponding passages 101 and 103 are adapted to deliver pressurized air to the interior of cylinder tube 39 upon opposite sides respectively of the first piston 41.

The second pneumatic control means, which includes cylinder adapter 59, cylinder cap 65 and cylinder tube 71, further includes a pair of air pressure ports C and D and corresponding passages 105 and 107 for connecting pressurized air alternately and selectively to the interior of the second cylinder tube 71 upon opposite sides respectively of the second piston 73.

Axially arranged with respect to the second pneumatic control means is the piston connector 77 slidably positioned and sealed within adjusting nut 81. Nut 81 is threaded into and through the cylinder cap 65 and has an internal axial bore 83 to receive piston connector 77.

Snap ring 85 is mounted over the inner end of adjusting nut 81 for limiting retracting adjustments of the adjusting nut 81 relative to cylinder cap 65. Lock nut 87 is threaded over adjusting nut 81 and is in operative retaining engagement with cylinder cap 65 for securing the adjusting nut 81 in the desired adjusted position.

The elongated adjusting screw 89 is axially threaded into piston connector 77, extends from opposite ends thereof and includes at its inner end a stop face 90 variably spaced with respect to the end of piston rod 49. A lock nut 91 is threaded onto the adjusting screw 89 for retaining the screw in the desired adjusted position to thereby determine the extent of upward axial movement of piston rod 49 and corresponding adjusted opening movement of the tapered valve member 57 corresponding to retracting movements of the first piston 41.

The second pneumatic control means includes the piston connector 77 and adjustably mounted thereon the adjusting screw 89 which is axially spaced from and serves as a variable adjustable stop for upward retracting movements of piston rod 49. Thus, by longitudinally adjusting the screw 89 relative to the piston connector 77, the extent of axial retracting movement of piston rod 49 and corresponding opening movement of the valve member 57 can be controlled, such as when the second piston 73 is in the position shown in FIG. 2.

When the second piston 73 under pneumatic control has been moved to a second retracted position above that shown in FIG. 2, then the adjusting screw 89 is spaced from the piston rod 49 and does not interfere with its retracting movement so that the tapered valve 57 can move to its fully opened position.

Snap ring 93 is mounted upon the lower end of adjusting screw 89 for limiting retracting movements of the screw relative to the piston connector 77. The formed guard 95 protectively overlies adjusting screw 89 and the adjusting nut 81 and includes an annular mount flange 97 mounted upon cylinder cap 65 and secured thereto by a series of screws 99, FIG. 1.

Figure 3:
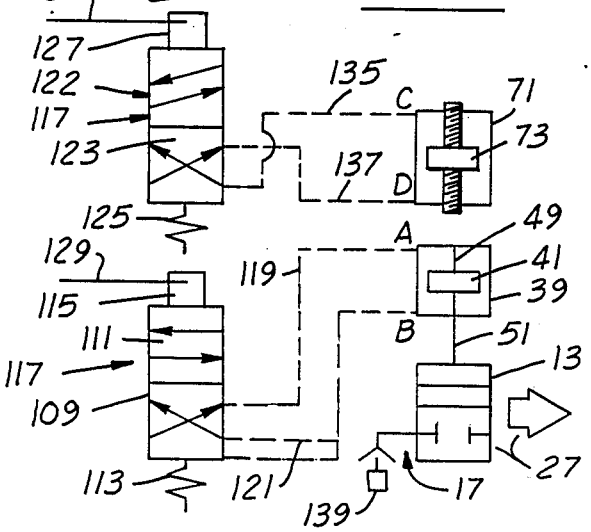
FIG. 3 is a schematic pneumatic diagram for the adjustable flow applicator shown in FIG. 2.

The respective, above-described first pneumatic control means for regulating, shutting and opening of the tapered valve 57 and the second pneumatic control means for controlling the extent of opening movement of the valve 57 includes a remote control mechanism in the form of directional control valve 109, schematically shown in the diagram, FIG. 3, for determining on and off positions of the tapered valve 57. The directional control valve 109 includes a reciprocal spool 111 schematically shown, spring-biased in one direction at 113 and moved in the opposite direction by the solenoid 115. The solenoid 115 has an electrical lead 129 adapted for connection to a remote control which is either manual or computerized, selectively determining when the solenoid 115 will be activated. By moving the spool 111 to an activated position pressurized air from a source 117 passes through the directional control valve 109 through conduit 121 and port B and corresponding passage 103 (FIG. 2) for registry with the first piston 41. This causes an opening movement of the tapered valve member 57 upwardly from the position shown in FIG. 2, permitting flow of pressurized fluidic material from the positive displacement constant flow rate dispenser 139, through port 17 and flow passage 15, and outwardly through orifice 17, FIGS. 2 and 3. The invention maintains at the orifice 27 a constant back pressure at the varying flow rates.

When the solenoid 115 is deactivated, spring 113 biases the spool 111 to a second control position so that pressurized air from source 117 passes through conduit 119, port A and passage 101 for moving the first piston 41 downwardly and the corresponding valve 57 to the shut-off position shown in FIG. 2.

The schematic illustration in FIG. 3 further shows a second directional control valve 122 having a reciprocal valve spool 123 spring-biased at 125 at one end and controlled for movement in the opposite direction by solenoid 127 having an electrical lead 131.

With the port B pressurized from directional control valve 109 and conduit 121, port C is pressurized through conduit 135 from the directional control valve 122, and through passage 105. Pressurized air from pressurized source 117 is delivered to the upper side of the second piston 73 extending the piston 73 to the position shown in FIG. 2. With the adjusting screw 89 in any position of longitudinal adjustment, axial movement of the piston rod 49 will be constrained, limiting retracting movement of the first piston 41 to a first position, providing a reduced flow rate of the fluidized material through the nozzle 25 which has a constant back pressure at orifice 27. In the event the flow is to be increased for a higher feed, the port D is activated through conduit 137, FIG. 3, from directional control valve 122 and the air passage 107 (FIG. 2). The second piston 73 is elevated from the position shown so that it is out of the way from retaining engagement with the retracting piston rod 49. Accordingly, the piston rod 49 can move a distance allowed by the adjustment nut 81, permitting a corresponding opening movement of the tapered valve 57 for the desired higher flow rate of the fluidized material through orifice 27.

In FIG. 1, there is a designated a robot center line 133 corresponding to the alignment of a suitable robotic arm, not shown, connected by a suitable bracket attached to the applicator body 13 by fasteners, not shown, extending through the mount holes 132, FIG. 2.

The present air-operated applicator 11 is designed to shift from a closed position shown in FIG. 2 to a full open position, a predetermined partial open position, or alternately from between two flow positions as required.

Once port B has been activated, opening the orifice 27, it is the operation of the second pneumatic control means, including the second piston 73, which determines whether it will be a full flow when fully opened or a partial flow when partially opened. The applicator 11 has a constant back pressure at the nozzle 25 at all times to accommodate the varying rates of flow during the two flow modes, whether partial rate or full flow rate. The applicator 11 as designed is based upon the orifice-metering principle, which states in part that "if the pressure drop across an orifice is maintained constant, the flow will be proportional to the orifice size."

When pressurized air is applied to port A, the applicator 11 closes. When air pressure is applied to port B, the applicator 11 opens. When pressurized air is applied to port B, the applicator 11 is allowed to partially open when port C is pressurized. When port D is pressurized, the applicator 11 is allowed to fully open when air is applied to port B.

The adjusting screw 89, as well as the adjusting nut 81, provides a means for setting the internal applicator pressure the same for both predetermined flow rates. Accordingly, upon translation of the present adjustable flow applicator 11 upon the end of a robotic arm, and following a predetermined path wherein there is a tight radius to be traversed sustaining a slowing down of the feed, there can be provided a corresponding slowing down of the rate of flow of the fluidized material through the orifice 27 under the control of the second pneumatic control means, including the second piston 73 and the respective directional control valve 121 of FIG. 3.

The aforementioned positive displacement constant flow rate dispenser is schematically shown at 139 FIG. 2. It includes a meter outlet 141 and a flexible conduit 143 which is connected to the inlet passage 17 of the applicator 11. Such constant flow rate dispenser is available from Jesco Products Co., Inc. of Sterling Heights, Mich., Model N-888.

With the positive displacement/constant flow rate equipment, the dispenser 139 changes flow rate instantaneously when commanded. Without a dual flow applicator or gun 11, when a change in flow rate is commanded to the dispenser 139, the flow rate at the tip of the gun or applicator does not change immediately and predictably to the new commanded flow rate. When the dispenser 139 changes flow rate there is a time lag before this flow rate is observed at the gun. This time lag is caused and affected by the following: (a) viscosity of the material and the higher the viscosity, the longer the time lag; (b) compressibility of the material; and (c) elasticity of material supply hose 143 connected between the dispenser 139 and gun.

Efforts have been made to have the robot "anticipate" this time lag between changes of flow rate and subsequently ramp its acceleration/deceleration to match the time lag associated with the change in flow rate. This has proven unsuccessful because the material characteristics are not constant. Material viscosity varies with temperature and the amount of shearing action imparted on it. In addition the viscosity varies from a batch to batch and also varies within the same batch of material. For these same reasons, orifice metering cannot work repeatably.

With the use of the dual flow applicator or gun 11, a change in flow rate at the dispenser 139 is related immediately at the tip of the applicator 11. This is accomplished by pre-adjusting the choked position of the applicator 11 for the low flow rate so that the pressure drop across the length of plumbing/hose from the meter outlet to the applicator 11 is maintained for both the low and high flow rates. The high flow rate position is also adjustable up to a maximum flow rate.

In essence, the operation of the applicator 11 uses the principle of orifice metering but in a larger scale/in a macroscopic point of view of the system. The dual flow applicator 11 is not used to change the flow rate of material to the tip of the gun. Its purpose is to maintain a constant pressure drop so that the dispenser 139 (who's flow rate output is immune to the variables mentioned) can change the flow rate and deliver the same change in flow rate to the gun tip immediately.

In applications where orifice metering is an acceptable method of dispensing materials, the dual flow applicator or gun 11 is used to change the flow rate of material dispensed at the tip of the nozzle.

Having described my invention reference should now be had to the following claims.

We claim:

1. An adjustable flow applicator for pressurized fluidic materials comprising:

a body having an axial flow passage and an inlet passage communicating therewith and adapted for connection to a source of pressurized fluidic material;

an axial nozzle connected to said body communicating with said flow passage and terminating in a converging orifice for feeding said material;

an axially reciprocal piston rod exension spaced within said flow passage and nozzle terminating in a tapered valve member having an advanced position normally seated within said orifice shutting off flow of fluidic material therethrough, and first and second retracted positions variably opening said orifice for a reduced flow rate of said material when in said first position and at an increased flow rate when in said second position;

first pneumatic control means axially mounted upon said body receiving said piston rod extension and including a first piston connected to said piston rod extension for effecting alternate reciprocal movements of said valve member for alternately opening and closing said orifice;

a piston rod connected to said piston; and a second pneumatic control means axially mounted upon said first pneumatic control means receiving said piston rod and including a reciprocal second piston;

said second piston having an advanced position limiting axial retracting movements of said piston rod and valve member to a limited retracted reduced flow position and an alternate retracted position axially outward of said piston rod so that said valve member may move to said increased flow rate position, said second piston having a greater surface area than said first piston.

2. The adjustable flow applicator of claim 1:

said first pneumatic means including an adaptor housing receiving said piston rod extension and assembled and sealed onto said body;

an adaptor cap axially spaced from said adaptor housing and receiving said piston rod;

a cylinder tube receiving said first piston and interposed between said adaptor housing and adaptor cap and sealed thereover; and a plurality of first fasteners interconnecting said adaptor cap, adaptor housing and body in compression.

3. The adjustable flow applicator of claim 2:

a main seal within said adaptor housing slidably receiving said piston rod extension for isolating and closing off said axial passage and inlet passage from said first control means.

4. The adjustable flow applicator of claim 2:

said adaptor housing and adaptor cap having a pair of pressure ports and passages communicating with the interior of said cylinder tube upon opposite sides of said first piston, adapted for alternate connection with a pressurized air source.

5. The adjustable flow applicator of claim 4 and a remote control for selectively pressurized said ports.

6. The adjustable flow applicator of claim 2:

said second pneumatic control means including a cylinder adaptor receiving said piston rod and axially assembled over and connected to said first pneumatic control means;

a cylinder cap axially spaced from said cylinder adaptor;

a cylinder tube receiving said second piston interposed between said cylinder adaptor and cylinder cap and sealed thereover; and fasteners interconnecting said cylinder cap and cylinder adaptor in compression.

7. The adjustable flow applicator of claim 1:

said first pneumatic control means including a pair of pressure ports and passages communicating with opposite sides of said first piston, adapted for alternate connection with a pressurized air source; and a remote control for selectively pressurizing said ports.

8. The adjustable flow applicator of claim 1:

said second pneumatic control means including a cylinder adaptor receiving said piston rod and axially assembled over and connected to said first pneumatic control means;

a cylinder cap axially spaced from said cylinder adaptor;

a cylinder tube receiving said second piston interposed between said cylinder adaptor and cylinder cap and sealed thereover; and fasteners interconnecting said cylinder cap and cylinder adaptor in compression.

9. The adjustable flow applicator of claim 8;

said cylinder adaptor and cylinder cap having a pair of pressure ports and passages communicating with the interior of said cylinder tube upon opposite sides of said second piston, adapted for alternate connection with a pressurized air source.

10. The adjustable flow applicator of claim 9;

and a second remote control for selectively pressurizing the ports on said second pneumatic control means.

11. The adjustable flow applicator of claim 1:

said second pneumatic control means including a pair of pressure ports and passages communicating with opposite sides of said second piston, adapted for alternate communication with a pressurized air source.

12. The adjustable flow applicator of claim 11: and a remote control for selectively pressurizing said latter ports.

13. An adjustable flow applicator for pressurized fluidic materials comprising:

a body having an axial flow passage and an inlet passage communicating therewith and adapted for connection to a source of pressurized fluidic material;

an axial nozzle connected to said body communicating with said flow passage and terminating in a converging orifice for feeding said material;

an axially reciprocal piston rod extension spaced within said flow passage and nozzle terminating in a tapered valve member having an advanced position normally seated within said orifice shutting off flow of fluidic material therethrough, and first and second retracted positions variably opening said orifice for a reduced flow rate of said material when in said first position and at an increased flow rate when in said second position;

first pneumatic control means axially mounted upon said body receiving said position rod extension and including a first piston connected to said piston rod extension for effecting alternate reciprocal movement of said valve member for alternately opening and closing said orifice;

a piston rod connected to said piston;

a second pneumatic control means axially mounted upon said first pneumatic control means receiving said piston rod and including a reciprocal second piston;

said second piston having an advanced position limiting axial retracting movements of said piston rod and valve member to a limited retracted reduced flow position and an alternate retracted position axially outward of said piston rod so that said valve member may move to said increased flow rate position; and an axial threaded shank depending from said body;

the connection of said nozzle to said body including a mount flange upon said nozzle; and an apertured collar receiving said nozzle and threaded on to said shank retainingly engaging said flange.

14. An adjustable flow applicator for pressurized fluidic materials comprising:

a body having an axial flow passage and an inlet passage communicating therewith and adapted for connection to a source of pressurized fluidic material;

an axial nozzle connected to said body communicating with said flow passage and terminating in a converging orifice for feeding said material;

an axially reciprocal piston rod extension spaced within said flow passage and nozzle terminating in a tapered valve member having an advanced position normally seated within said orifice shutting off flow of fluidic material therethrough, and first and second retracted positions variable opening said orifice for a reduced flow rate of said material when in said first position and at an increased flow rate when in said second position;

first pneumatic control means axially mounted upon said body receiving said piston rod extension and including a first piston connected to said piston rod extension for effecting alternate reciprocal movements of said valve member for alternately opening and closing said orifice;

a piston rod connected to said piston;

a second pneumatic control means axially mounted upon said first pneumatic control means receiving said piston rod and including a reciprocal second piston;

said second piston having an advanced position limiting axial retracting movements of said piston rod and valve member to a limited retracted reduced flow position and an alternate retracted position axially outward of said piston rod so that said valve member may move to said increased flow rate position;

a main seal within said adaptor housing slidably receiving said piston rod extension for isolating and closing off said axial passage and inlet passage from said first control means; and an apertured seal washer within said body axially engaging said adaptor housing and said main seal and receiving said piston rod extension.

15. An adjustable flow applicator for pressurized fluidic materials comprising:

a body having an axial flow passage and an inlet passage communicating therewith and adapted for connection to a source of pressurized fluidic material;

an axial nozzle connected to said body communicating with said flow passage and terminating in a converging orifice for feeding said material;

an axially reciprocal piston rod extension spaced within said flow passage and nozzle terminating in a tapered valve member having an advanced position normally seated within said orifice shutting off flow of fluidic material therethrough, and first and second retracted position variable opening said orifice for a reduced flow rate of said material when in said first position and at an increased flow rate when in said second position;

first pneumatic control means axially mounted upon said body receiving said piston rod extension and including a first piston connected to said piston rod extension for effecting alternate reciprocal movements of said valve member for alternately opening and closing said orifice;

a piston rod connected to said piston;

a second pneumatic control means axially mounted upon said first pneumatic control means receiving said piston rod and including a reciprocal second piston;

said second piston having an advanced position limiting axial retracting movements of said piston rod and valve member to a limited retracted reduced flow position and an alternate retracted position axially outward of said piston rod so that said valve member may move to said increased flow rate position;

a main seal within said adaptor housing slidably receiving said piston rod extension for isolating and closing off said axial passage and inlet passage from said first control means;

an axial piston connector extending through and secured to said second piston and having an axial bore therethrough; and an adjusting screw threaded into said piston connector and extending from its opposite ends;

one end of said adjusting screw being variably spaced from and aligned with said piston rod for variably setting said first retracted position.

16. The adjustable flow applicator of claim 15:

and a lock nut on the other end of said adjusting screw operatively engaging said piston connector.

17. The adjustable flow applicator of claim 15:

and an adjusting nut axially threaded into said second pneumatic control means slidably receiving and sealed over said piston connector.

18. The adjustable flow applicator of claim 17:

the source of pressurized fluidic material including a positive displacement constant flow rate dispenser with a meter outlet and conduit for feeding the material to said inlet passage;

said adjusting screw and adjusting nut pre-setting the low and high flow rates so that the pressure drop across the length of said conduit from the meter outlet to the inlet passage is the same, thereby providing instantaneously selectible high and low flow rates.

19. An adjustable flow applicator for pressurized fluidic materials comprising:

a body having an axial flow passage and an inlet passage communicating therewith and adapted for connection to a source of pressurized fluidic material;

an axial nozzle connected to said body communicating with said flow passage and terminating in a converging orifice for feeding said material;

an axially reciprocal piston rod extension spaced within said flow passage and nozzle terminating in a tapered valve member having an advanced position normally seated within said orifice shutting off flow of fluidic material therethrough, and first and second retracted positions variably opening said orifice for a reduced flow rate of said material when in said first position and at an increased flow rate when in said second position;

first pneumatic control means axially mounted upon said body receiving said piston rod extension and including a first piston connected to said piston rod extension for effecting alternate reciprocal movements of said valve member for alternately opening and closing said orifice;

a piston rod connected to said piston;

a second pneumatic control means axially mounted upon said first pneumatic control means receiving said piston rod and including a reciprocal second piston;

said second piston having an advanced position limiting axial retracting movements of said piston rod and valve member to a limited retracted reduced flow position and an alternate retracted position axially outward of said piston rod so that said valve member may move to said increased flow rate position;

said second pneumatic control means including a cylinder adapter receiving said piston rod and axially assembled over and connected to said first pneumatic control means;

a cylinder cap axially spaced from said cylinder adaptor;

a cylinder tube receiving said second piston interposed between said cylinder adapter and cylinder cap and sealed thereover;

fasteners interconnecting said cylinder cap and cylinder adaptor in compression;

an axial piston connector extending through and secured to said second piston and having an axial bore therethrough; and an adjusting screw threaded into said piston connector and extending from its opposite ends;

one end of said adjusting screw being variably spaced from and aligned with said piston rod for variably setting said first retracted position of said valve member.

20. The adjustable flow applicator of claim 19:

and an adjusting nut axially threaded through said cylinder cap slidably receiving and sealed over said piston connector, adapted to variably limited retracting movements of said second piston.

21. An adjustable flow applicator for pressurized fluidic materials comprising:

a body having an axial flow passage and an inlet passage communicating therewith and adapted for connection to a source of pressurized fluidic material;

an axial nozzle connected to said body communicating with said flow passage and terminating in a converging orifice for feeding said material;

an axially reciprocal piston rod extension spaced within said flow passage and nozzle terminating in a tapered valve member having an advanced position normally seated within said orifice shutting off flow of fluidic material therethrough, and first and second retracted positions variable opening said orifice for a reduced flow rate of said material when in said first position and at an increased flow rate when in said second position;

first pneumatic control means axially mounted upon said body receiving said piston rod extension and including a first piston connected to said piston rod extension for effecting alternate reciprocal movements of said valve member for alternately opening and closing said orifice;

a piston rod connected to said piston;

a second pneumatic control means axially mounted upon said first pneumatic control means receiving said piston rod and including a reciprocal second piston;

said second piston having an advanced position limiting axial retracting movements of said piston rod and valve member to a limited retracted reduced flow position and an alternate retracted position axially outward of said piston rod so that said valve member may move to said increased flow rate position;

said first pneumatic means including an adaptor housing receiving said piston rod extension and assembled and sealed onto said body;

an adaptor cap axially spaced from said adaptor housing and receiving said piston rod;

a cylinder tube receiving said first piston and interposed between said adaptor housing and adaptor cap and sealed thereover;

a plurality of first fasteners interconnecting said adaptor cap, adaptor housing and body in compression;

said second pneumatic means including a depending apertured mount flange overlying said adaptor cap; and said plurality of fasteners retainingly engaging said mount flange.

22. An adjustable flow applicator for pressurized fluidic materials comprising:

a body having an axial flow passage and an inlet passage communicating therewith and adapted for connection to a source of pressurized fluidic material;

an axial nozzle connected to said body communicating with said flow passage and terminating in a converging orifice for feeding said material;

an axially reciprocal piston rod extension spaced within said flow passage and nozzle terminating in a tapered valve member having an advanced position normally seated within said orifice shutting off flow of fluidic material therethrough, and first and second retracted positions variably opening said orifice for a reduced flow rate of said material when in said first position and at an increased flow rate when in said second position;

first pneumatic control means axially mounted upon said body receiving said piston rod extension and including a first piston connected to said piston rod extension for effecting alternate reciprocal movements of said valve member for alternately opening and closing said orifice;

a piston rod connected to said piston;

a second pneumatic control means axially mounted upon said first pneumatic control means receiving said piston rod and including a reciprocal second piston;

said second piston having an advanced position limiting axial retracting movements of said piston rod and valve member to a limited retracted reduced flow position and an alternate retracted position axially outward of said piston rod so that said valve member may move to said increased flow rate position;

a main seal within said adaptor housing slidably receiving said piston rod extension for isolating and closing off said axial passage and inlet passage from said first control means;

said second pneumatic control means including a cylinder adaptor receiving said piston rod and axially assembled over and connected to said first pneumatic control means;

a cylinder cap axially spaced from said cylinder adaptor;

a cylinder tube receiving said second piston interposed between said cylinder adaptor and cylinder cap and sealed thereover;

fasteners interconnecting said cylinder cap and cylinder adaptor in compression;

an axial piston connector extending through and secured to said second piston and having an axial bore and further extending through said cylinder cap; and an adjusting screw threaded into said piston connector and extending from its opposite ends;

one end of said adjusting screw being variably spaced from and aligned with said piston rod for variably setting said first retracted position of said valve member.

* * * * *